US009945136B2

(12) United States Patent
Ward

(10) Patent No.: US 9,945,136 B2
(45) Date of Patent: Apr. 17, 2018

(54) SPRING LOADED WALER BRACKET ASSEMBLY

(71) Applicant: Philip T Ward, Grandview, MO (US)

(72) Inventor: Philip T Ward, Grandview, MO (US)

( * ) Notice: Subject to any disclaimer, the term of this patent is extended or adjusted under 35 U.S.C. 154(b) by 273 days.

(21) Appl. No.: 14/669,893

(22) Filed: Mar. 26, 2015

(65) Prior Publication Data

US 2016/0281376 A1 Sep. 29, 2016

Related U.S. Application Data

(60) Provisional application No. 62/101,829, filed on Jan. 9, 2015.

(51) Int. Cl.

| | |
|---|---|
| ***E04G 17/14*** | (2006.01) |
| ***E04G 17/04*** | (2006.01) |
| ***E04G 17/00*** | (2006.01) |
| ***E04G 9/06*** | (2006.01) |
| ***E04G 11/06*** | (2006.01) |

(52) U.S. Cl.

CPC ..... *E04G 17/14* (2013.01); *E04G 9/06* (2013.01); *E04G 11/06* (2013.01); *E04G 17/002* (2013.01); *E04G 17/04* (2013.01)

(58) Field of Classification Search

CPC ..... E04G 17/14; E04G 17/002; E04G 5/06; E04G 5/067

USPC ..... 248/229.1, 235; 249/219.1, 219.2

See application file for complete search history.

(56) References Cited

U.S. PATENT DOCUMENTS

| | | | | |
|---|---|---|---|---|
| 1,743,811 | A * | 1/1930 | Eull | E04G 17/0751 249/213 |
| 2,133,574 | A * | 10/1938 | Roemisch | E04G 17/0752 249/213 |
| 3,137,052 | A * | 6/1964 | Jennings | E04G 17/04 403/398 |
| 3,347,510 | A * | 10/1967 | Buyken | E04G 17/0754 248/222.41 |
| 3,426,992 | A * | 2/1969 | Buyken | E04G 17/07 249/219.2 |
| 3,462,107 | A * | 8/1969 | Buyken | A47B 96/061 248/205.1 |
| 3,462,108 | A * | 8/1969 | Buyken | A47B 96/061 248/205.1 |
| 3,529,800 | A * | 9/1970 | Harris | E04G 17/0721 249/213 |
| 3,965,542 | A | 6/1976 | Gregory | |
| 4,219,180 | A | 8/1980 | Strickland | |
| 5,968,403 | A | 10/1999 | Myers et al. | |
| 6,322,047 | B1 | 11/2001 | Holmboe, Jr. | |
| 7,350,760 | B2 * | 4/2008 | Yamaura | B25B 5/08 24/327 |
| 9,045,912 | B2 * | 6/2015 | Fearn | E04G 17/14 |

(Continued)

*Primary Examiner* — Michael Safavi

(74) *Attorney, Agent, or Firm* — John C. McMahon

(57) ABSTRACT

A waler bracket for use with a concrete wall form includes a main frame portion connecting arm attached to a framing wall stud projecting from the wall form, a spring including a first and second end, a handle attached the connecting arm and to a cam-lock. The handle moves between non clamping and clamping configurations thereof, and rotates the cam-lock, which in turn engages the spring such that the first and second ends act in torsion, such that the first end engages the second end in compression, which in turn causes an abutment against a waler.

23 Claims, 6 Drawing Sheets

(56) References Cited

U.S. PATENT DOCUMENTS

2014/0166849 A1* 6/2014 Fearn ..... E04G 17/14
249/219.2

* cited by examiner

SPRING LOADED WALER BRACKET ASSEMBLY

CROSS-REFERENCE TO RELATED APPLICATIONS

This application claims the benefit of U.S. Provisional Patent Application 62/101,829, filed Jan. 9, 2015.

BACKGROUND OF THE INVENTION

The present invention relates to construction and concrete forming apparatus and, in particular, to a waler bracket for use with a concrete wall form.

Formwork or forming is used to contain and shape cementitious or other flowable construction material, such as concrete, during the pouring and setting, or curing, processes. One common use of formwork or forms is in the casting of walls. In forming or the use of forms, an outer form includes of a series of connected form walls or panels positioned in parallel vertical planes spaced a horizontal distance from a corresponding set of inner form panels to create a space within which the concrete is poured. The concrete form wall is reinforced by an exterior structure that may be made up of plywood and flanges horizontal beams formed by beam members, such as boards set edgewise to the walls. Ties are usually connected between the inner and outer form walls for retaining the walls against spreading, and these may extend horizontally through openings provided in the walls for connection of their opposite outer ends to horizontally extending reinforcing members, which are customarily mounted across and supported on the outer edge faces of the form wall or studs. These latter supporting members or stringers or walers connected to the outer form walls by wale brackets or C brackets and are often composed of two 2"×4" boards, set edgewise to the walls. Walers are often arranged in pairs with some horizontal spacing provided therebetween to receive outer ends of tie wire which are fastened to outer faces of the walers by various adjustable securing means and wedges, as is well known in the art.

"Dimensional lumber" refers to lumber cut to standardized width and thickness. The nominal dimensions, such as two inches by four inches (or 2×4), are usually larger than the actual dimensions. Additionally, there are some variations in the actual dimensions of available lumber. It would be highly desirable to have a waler support bracket in the concrete form industry with a means of adjustment to accommodate for tolerance variations in lumber size.

SUMMARY OF THE INVENTION

The present invention is directed to a waler bracket arrangement which securely engages a waler to a concrete form panel, which is convenient to operate, and which can accommodate some variation in the dimensions of the waler. The bracket arrangement includes a waler clamp device for releasably securing a waler to a panel and comprising: a mounting member adapted for securing to a panel, a clamp member connected to the mounting member, and the clamp member including a resilient clamp component positioned to resiliently urge a waler toward a panel to thereby releasably secure the waler to the panel.

An embodiment of the clamp device includes a resilient or spring clamp member which is moved into clamping configuration, engaging with a waler to clamp the waler to the panel, and is moved to a non-clamping or release configuration to release the waler from the bracket arrangement.

The spring clamp member may be urged into the clamping and non-clamping configurations by engagement of a clamp securing member therewith, such as a rotary cam member rotated by operation of a cam lever. Preferably, the spring clamp member is rotated about a pivot between the clamping and non-clamping configurations, and urged into the clamping configuration due to biasing of the clamp member by rotation of the cam member. In another embodiment of the waler clamp device, a clamp securing wedge is selectively driven between the mounting member and the clamp member to urge the clamp member to the waler clamping configuration and to secure the clamp member in such a configuration.

An embodiment of a waler clamp device for releasably securing a waler to a panel, according to the present invention, comprises: a mounting member adapted for securing to a panel; a clamp member connected to the mounting member and movable between a waler clamping configuration and a waler release configuration; a cam member connected the mounting member and having a cam surface engaging the clamp member whereby movement of the cam member causes movement of the clamp member between the clamping configuration and the release configuration; and a cam lever secured to the cam member to enable movement of the cam member to thereby urge the clamp member to the clamping configuration to clamp a waler to a panel and to the release configuration to release a waler therefrom.

The mounting member may include an elongated mounting plate having a length to enable positioning the clamp member in a selected spaced relation to the panel. Alternatively, the mounting member may include a pair of mounting plates secured in substantially parallel spaced relation and having the clamp member, the cam member, and the cam lever positioned therebetween.

The clamp member may be pivotally connected to the mounting member and is pivoted between the release configuration and the clamping configuration. Similarly, the cam member may be pivotally connected to the mounting member whereby the cam lever pivots the cam member to thereby urge the clamp member to the clamping and release configurations.

In an embodiment of the waler bracket device, the clamp member may include a first leg engaged by the cam member and a second leg angularly extending from the first leg and being positioned to engage a waler to clamp the waler to a panel. The clamp member is preferably formed of a resilient material whereby the clamp member resiliently engages a waler clamped thereby or is resiliently biased against one or more walers in the clamping configuration of the device.

In an embodiment of the waler bracket device, the clamp member includes a resilient element formed into an L-shape clamp member including a clamp arm and a cam follower. The cam member engages the cam follower in such a manner as to cause the clamp leg to be pivoted into resilient engagement with a waler when the cam lever is pivoted from the release configuration to the clamping configuration. The resilient element may be formed into a shape similar to an outline of the letter "L" and include a clamp arm with a free end to enable resiliently biased engagement of the clamp arm with a waler.

In an embodiment of the invention, one or more waler bracket clamp devices are combined with sets of concrete form panels to releasably secure one or more waler members to the panels.

A waler bracket clamp embodiment according to the invention includes: a connecting arm, the connecting arm projecting outward in a first axis; a handle being attached to the connecting arm and to a cam-lock; a spring attached to the connecting arm, a portion of the spring being L-shaped; and wherein the handle moves the cam-lock, such that the cam-lock engages the spring to move the spring portion from one of a locked and unlocked position.

Another aspect of this embodiment further includes a plurality of vertical panels arranged in a side-by-side edge abutting array, said panels interconnected by joining means mounted on studs projecting from the face of adjoining panels, the connecting arm of a clamp being attachable to the studs of adjoining panels.

In another aspect of this embodiment, the connecting arm further includes an aperture defining an aperture inner surface at an approximate terminal end, the connecting arm terminal end being perpendicular to the wall form panel, and wherein the aperture inner surface is sized to interact with: a nut and bolt in combination, a tie rod, a pin, a stud of an adjacent wall form panel, or a nut with wedge in combination.

In another embodiment according to the invention, the connecting arm is wedged shaped.

Another aspect of this embodiment further includes a lower leg with a circular pathway aperture and interior surface, aperture interior surface being sized to interact with at least one of: a nut and bolt in combination, a tie rod, a pin, a stud of an adjacent wall form panel, and a nut with wedge in combination.

Another aspect of this embodiment further includes a U-shaped structure being attached to a top surface of the connecting arm, such that an interior curved surface of the U-shaped structure is wide enough for at least two studs of a wall form panel, so as to reinforce at least wall form panels together and maintain the clamp in position.

In another aspect of this invention the leg, in a locked position, engages at least one crosspiece against a wall form panel, such that the crosspiece is immobile and locked against the wall form panel. It is foreseen that the crosspiece may have a rectangular cross section.

According to an aspect of the invention, in combination with a plurality of vertical panels arranged in a side-by-side edge abutting array, the panels are interconnected by joining means mounted on studs projecting from the face of adjoining panels, and a plurality of waler bracket clamps secure a waler to the faces of the panels, aligning the faces of said panels into a common plane, each of said bracket clamps comprising, in combination: a connecting arm, the connecting arm projecting outward in a first axis; a handle being attached to the connecting arm and to a cam-lock; a spring attached to the connecting arm, a portion of the spring being L-shaped; and wherein the handle moves the cam-lock, such that the cam-lock engages the spring to move the spring portion from one of a locked and unlocked position.

In another aspect of this invention, a spring loaded waler bracket assembly to align and reinforce a plurality of adjacent panels forming a poured concrete wall form is provided, each of the panels having a generally planar panel portion and a stud extending along each side edge thereof from a rear surface of the panel portion, each panel being positioned next to a similarly oriented adjacent panel with the studs of the adjacent panels being juxtaposed to each other, each stud having apertures therein which are aligned with similar holes in the stud of the adjacent panel so that pins can be inserted into the aligned holes to connect the panels together and form the wall form, the spring loaded waler bracket assembly comprising: a plurality of clamps, each clamp having a connecting arm, the connecting arm projecting outward in a first axis and connecting the clamp to a stud; a handle being attached to the connecting arm and to a cam-lock; a spring attached to the connecting arm, a portion of the spring being L-shaped; and wherein the handle moves the cam-lock, such that the cam-lock engages the spring to move the spring portion from one of a locked and unlocked position; a crosspiece; and wherein when in the unlocked position, the crosspiece can be loaded onto the clamps and rested on respective top surfaces of connecting arms thereof, and wherein when the handle is moved into the locked position, the crosspiece is pushed to the wall form by the L-shaped portion of the spring, so as to align and reinforce the associated panels during the pouring and curing of the concrete wall.

In another aspect of this embodiment, further including a first end portion and a second end portion, the first end portion is shifted as the handle cams the cam lock so as to engage the second end portion and compresses against the second end portion, as the second end portion engages the crosspiece, the crosspiece is pushed to the wall form, so as to align and reinforce the associated panels during the pouring and curing of the concrete wall.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
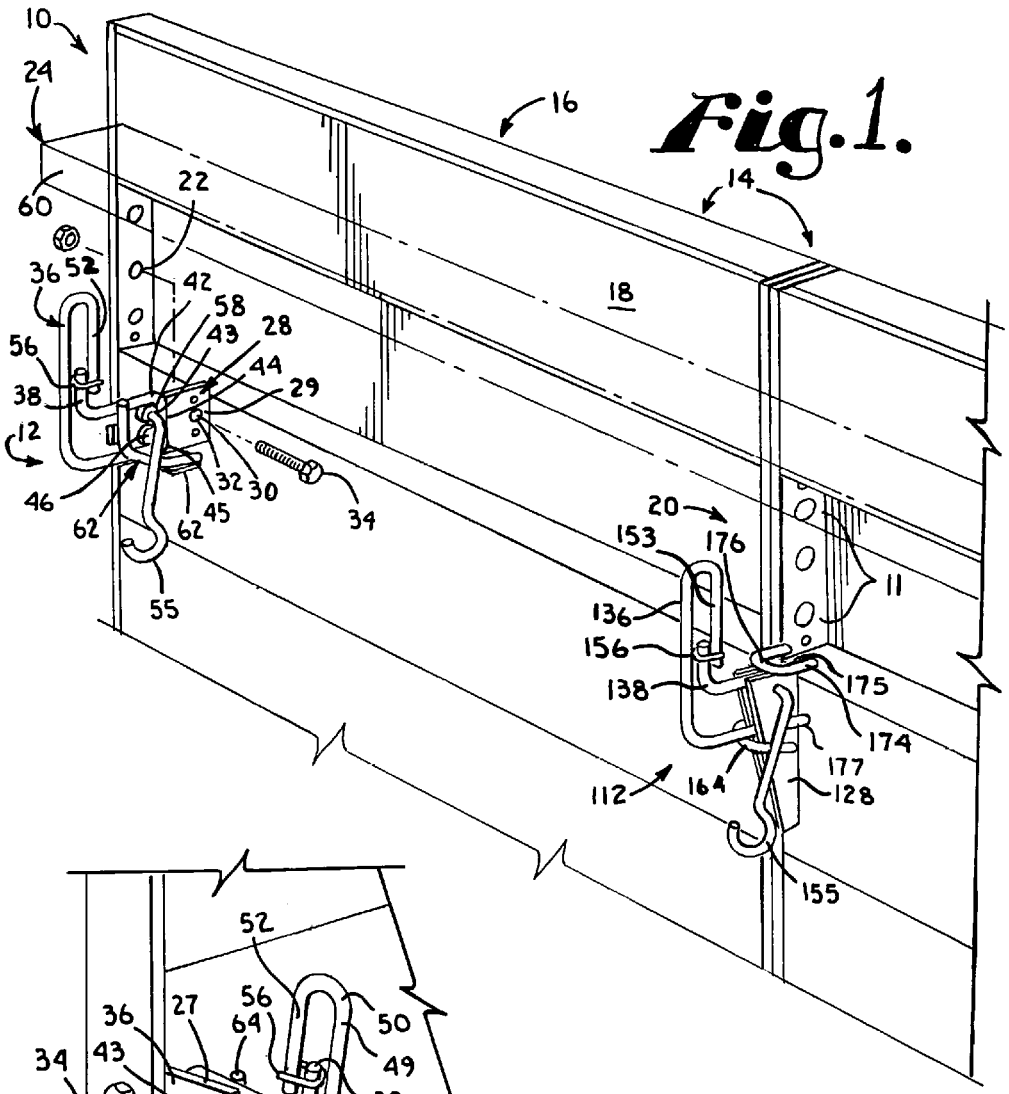
FIG. 1 shows a fragmentary perspective view of a spring loaded waler bracket assembly according to the present invention, showing a partial view of a concrete form, a waler in phantom, and including first and second embodiments of spring loaded waler bracket clamps.

Referring to FIG. 1, an embodiment of a spring loaded waler bracket assembly 10 according to the present invention is shown. The spring loaded waler bracket assembly 10 includes a first clamp 12 and a second clamp 112 each of which is attached at a juncture 11 between adjacent panels 14 forming a concrete wall form 16. Each panel 14 includes a planar panel portion 18 and studs 20 projecting outwardly from the panel portion 18 along spaced side ends thereof, each stud 20 usually being a set horizontal distance apart. Each stud 20 includes a plurality of apertures 22, which are aligned with the respective apertures 22 in the same panel and adjacent panels 14. It will be appreciated by one of ordinary skill in the art that the wall form 16 shown in FIG. 1 may be used in conjunction with a similar configured wall form 16 to define a space therebetween into which concrete (not shown) is poured and allowed to cure to form a poured concrete wall (not shown).

Additionally, although a particular configuration is shown and described for each of the panels of the wall form, it will be appreciated that the bracket assembly 10 according to this invention can be used on a variety of configurations of panels and wall form designs, including curved wall panels.

Figure 6:
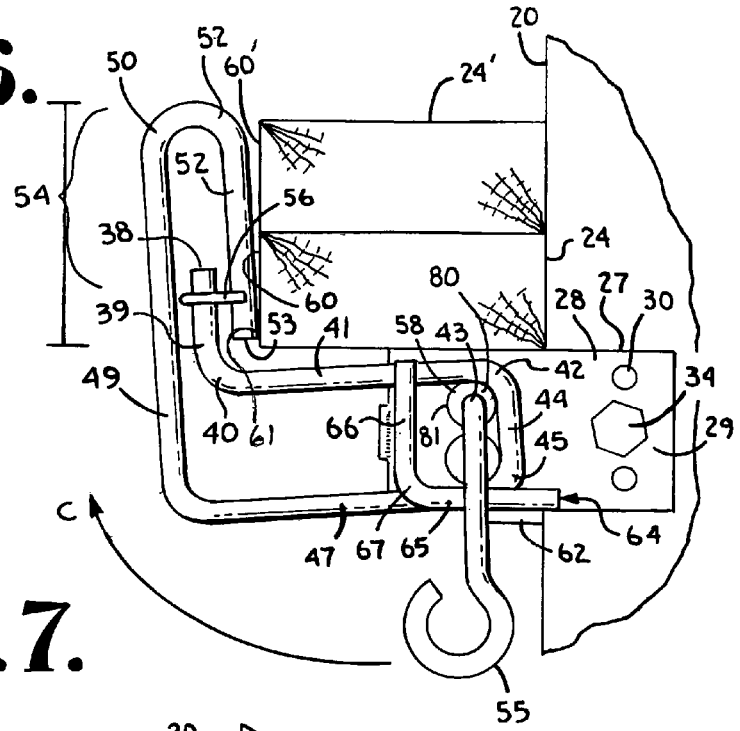
FIG. 6 is a fragmentary side elevational view of the form, walers, and the first spring loaded waler bracket clamp according to the present invention in the non-clamping configuration, showing the walers loaded into the first spring loaded waler bracket clamp.
Figure 7:
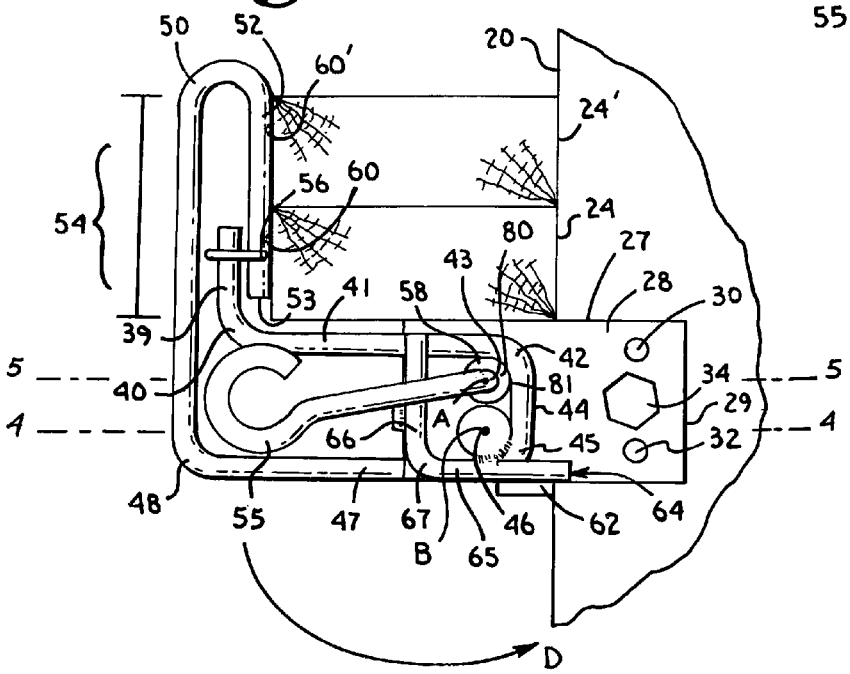
FIG. 7 is a view similar to FIG. 6, with the first spring loaded waler bracket clamp shown in a clamping configuration and showing the first spring loaded waler bracket clamp resiliently biased against the walers.

The spring loaded waler bracket assembly 10, further includes at least one waler or beam crosspiece 24 extending generally horizontally across a plurality of adjacent panels 14 forming the wall form 16 and across at least two clamps, such as clamps 12 and 112. The bracket assembly 10 incorporates at least two crosspieces 24 and 24', crosspiece 24' atop the crosspiece 24, to reinforce and align the panels 14 of the wall form 16, as seen in FIGS. 6 and 7. The crosspieces 24 and 24' and the associated clamps 12 and 112 have similar components across several adjacent panels 14 according to this invention with the exception of the position of the respective components. The clamp 12 is positionable between one or two adjacent panels 14, and the second embodiment, clamp 112, is positioned between at least two adjacent panels 14, as will be described below. The crosspiece 24 is shown above the clamps 12 and 112 in FIG. 1, prior to loading.

The crosspieces 24 and 24' according to the invention may be constructed of 2"×4"; 2"×6"; or 2"×8" wooden lumber, similarly sized aluminum or other like material. Although nominally dimensioned, the actual dimensions of each crosspiece 24 and 24' may vary somewhat within a given tolerance.

Figure 2:
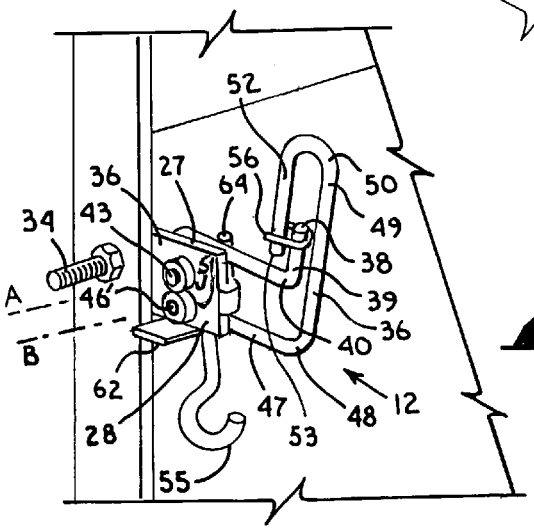
FIG. 2 is a somewhat enlarged fragmentary perspective view of the form and a first spring loaded waler bracket clamp with the clamp in a non-clamping configuration.
Figure 2A:
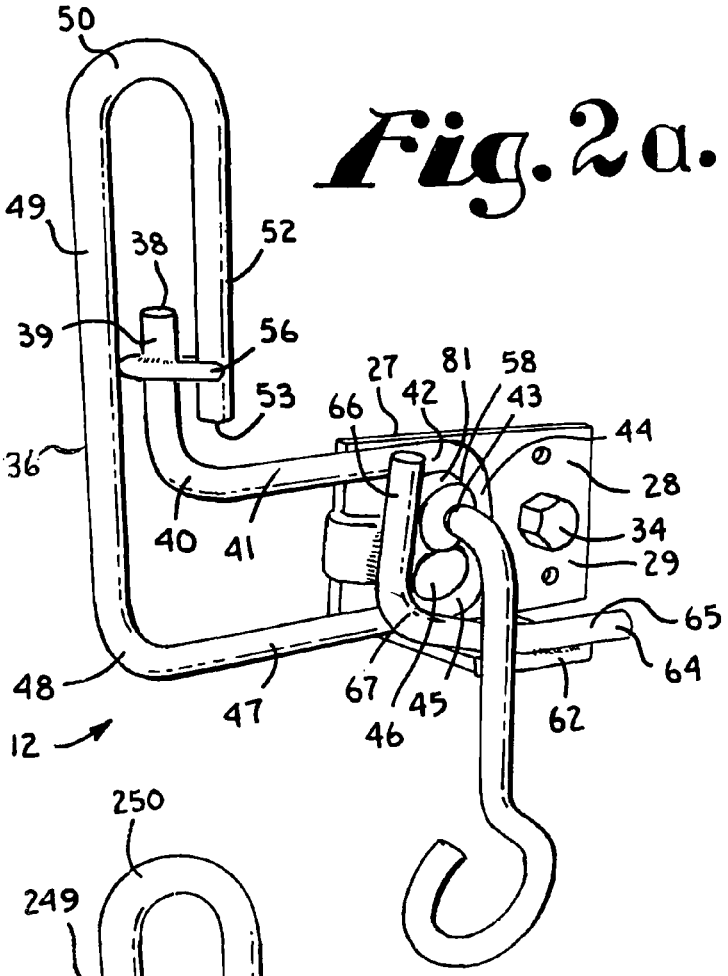
FIG. 2*a* is an enlarged perspective view of the first spring loaded waler bracket clamp in a non-clamping configuration.
Figure 2B:
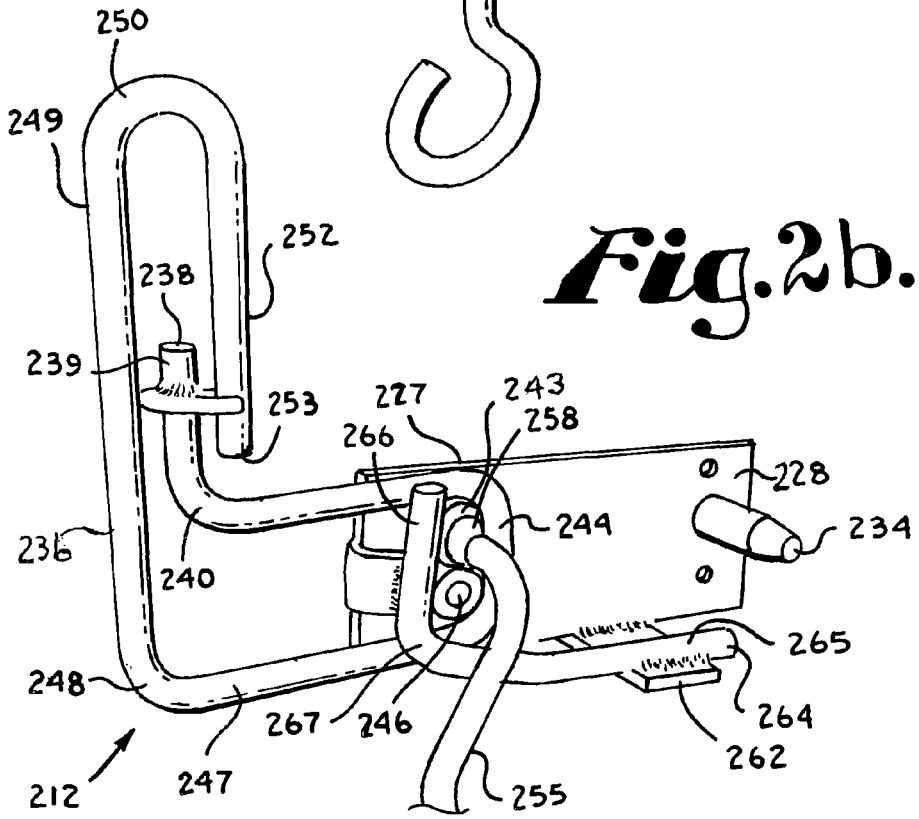
FIG. 2*b* is enlarged fragmentary perspective view of a third spring loaded waler bracket clamp in a non-clamping configuration.

With reference to FIGS. 2*a* and 2*b*, a clamp 12 and a clamp 212 are shown. The clamp 212, seen in FIG. 2*b* has similar features to clamp 12, except for the elongated connecting arm 228 and top surface 227, these features will be further described below. As seen in FIG. 2-5, the clamp 12 includes a connecting arm or mounting member 28, to provide structure to secure the clamp 12 to the studs 20 and for insertion between or against at least one stud 20 on the wall form panels 14. The various sizes of the crosspieces 24 and 24' can be accommodated with appropriately sized and configured clamps 12 and 212 according to this invention, in many cases a larger crosspiece (not shown) could be accommodated by lengthening top surface 27 of the connecting arm or plate 28 to a top surface 227 of connecting arm 228 of the clamp 212, as seen in FIG. 2*b*.

The clamp 12 has an aperture 30 (FIG. 1) with an interior surface 32 formed in the connecting arm 28. The aperture 30 and interior surface 32 are sized and configured similar to the apertures 22 in the studs 20, such that the apertures 22 and 30 can be coaxially aligned and the clamp 12 can be secured to the studs 20 of the adjacent panels 14 by inserting a pin 34 therethrough. It is foreseen that the pin 34 may be a bolt in combination with a nut (see FIG. 1), or an elongate shaft (not shown) or a slot (not shown) through which a wedge (not shown) or the like can be inserted to securely anchor the pin 34 and thus join the adjacent panels 14 together.

The illustrated clamp 12 includes a clamp member, referred to herein as a spring 36, pivotally mounted on the connecting arm 28. Preferably, the illustrated spring 36 is constructed from a single, unitary, integral, or monolithic elongated rod of constant cross section that is formed or bent at various locations therealong to form a clamp member having a substantially planar shape resembling an outline of the letter "L". As used herein, the term "monolithic" describes a single element, such as a rod, which is formed to a desired shape. The spring 36 has a first end 38, the first end 38 having a first end portion 39 being slightly non-parallel to the wall form 16 when the clamp 12 is in a non-clamping configuration thereof such as seen in FIG. 6. The first end portion 39 is adjacent a first section 40, that is radiused and forms a corner. The first section is in turn adjacent to an upper leg portion 41. The upper leg portion 41 runs substantially perpendicular to the wall form 16 in the non-clamping configuration. Continuing along the spring 36, adjacent to the upper leg portion 41 is a second section 42 that is radiused and forms a corner. The second section 42 is spaced from a first pivot crank 43. The first pivot crank 43 has a lever or handle 55. Adjacent the second section 42 is a cam engaging or cam follower portion 44, which in turn is adjacent a third section 45 that is radiused and forms a corner. The third section 45 is radiused about and secured, as by welding, to a pivot 46, which in the illustrated embodiment is formed by a pivot shaft 46' (FIG. 2) extending through an aperture (not shown) in the connecting arm 28 which has pivot retainers 51 joined to opposite ends of the shaft 46'.

Continuing further along the spring 36, and adjacent the third section 45 is a lower leg portion 47. The lower leg portion 47 is generally perpendicular to the wall panel 14 in the non-clamping configuration and substantially parallel to the upper leg portion 41. Opposite the third section on the lower leg portion is a fourth section 48 that is radiused and forms a corner. The fourth section 48 in turn is adjacent a first arm 49 that extends upwardly from the fourth section 48 to run slightly off parallel with respect to the studs 20 when in the non-clamping configuration. The first arm 49 upwardly ends in a fifth section 50 that is radiused and forms a corner and that extends approximately 180 degrees. Extending downwardly from the fifth section 50 is a second arm 52 that clamps and that extends to a terminus or free end 53. The first arm 49 and second arm 52 of the spring 36 form a saddle with the fifth section 50 in a U-shape about the first end 38 and the first end portion 39 of the spring 36.

A length 54 of second arm 52 is preferably the height of at least two crosspieces 24, such that in the clamped configuration, the second arm 52 is able to engage at least two crosspieces 24 and 24', as shown in FIG. 7. The second arm 52, thus, is a clamp component which engages the crosspieces 24 and 24'. The first end portion 39 further includes a first set of alignment arms 56 near the first end 38 of the spring 36. The first set of alignment arms 56 and the first end portion 39 create a U-shaped structure, such that the second arm 52 of the spring 36 is captured between the first set of alignment arms 56.

The spring 36 and connecting arm 28 may be made from a resilient or spring-like material, such as steel (especially heat treated carbon steel), aluminum or another metal, or molded as an integral unit from a polymer or the like. The spring 36 shown is a simple torsion or flex spring, but it is foreseen that other types of springs, such as, but not limited to: tension, compression, coil, or the like springs, may be used. It is foreseen that the spring 36 may be any shape in cross-section, shown in FIGS. 1-7 as a cylinder in cross section.

Referring to FIGS. 1 and 3-7, clamp 12 includes a brace arm 62, operably attached to the connecting arm 28, and extending perpendicularly from either side of the connecting arm 28. The brace arm 62 includes an L-shaped brace 64, having a lower portion 65, and upper portion 66, and a curved portion 67. The lower portion 65 connects to the brace arm 62 on a side 29 of the connecting arm 28. Adjacent to the lower portion 65 is the curved portion 67, and in turn adjacent to the curved portion 67 is the upper portion 66. The upper portion 66 functions as a brace to prevent the spring 36 from moving outward away from the connecting arm 28 under load. Like the spring 36, the brace 64 and brace arm 62 may be constructed of steel, aluminum or another metal, or rigid polymer such as nylon or another material. It is foreseen that the brace arm 62 may be any shape in cross-section, and is shown in FIGS. 1-7 as a cylinder in cross section.

Figure 5:
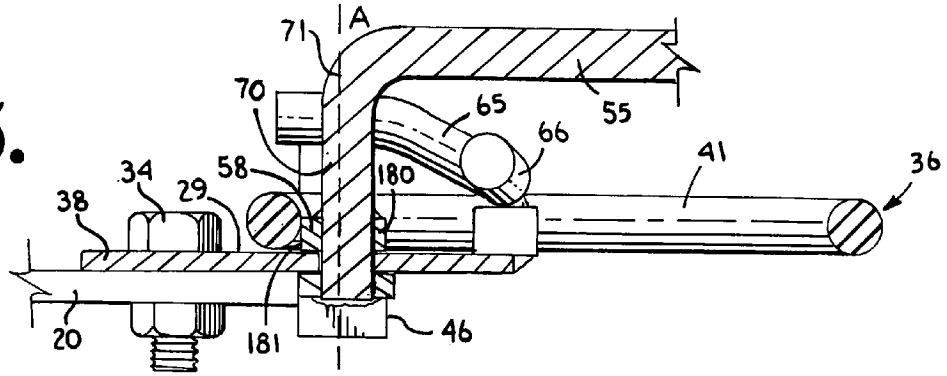
FIG. 5 is a fragmentary cross sectional view of the first spring loaded waler bracket clamp, taken along line 5-5 of FIG. 7.
Figure 4:
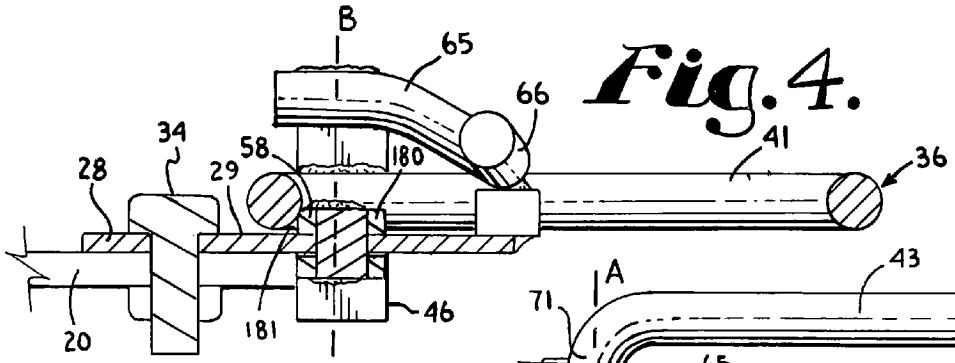
FIG. 4 is a fragmentary cross sectional view of the form and the first spring loaded waler bracket clamp, taken along line 4-4 of FIG. 7.
Figure 3:
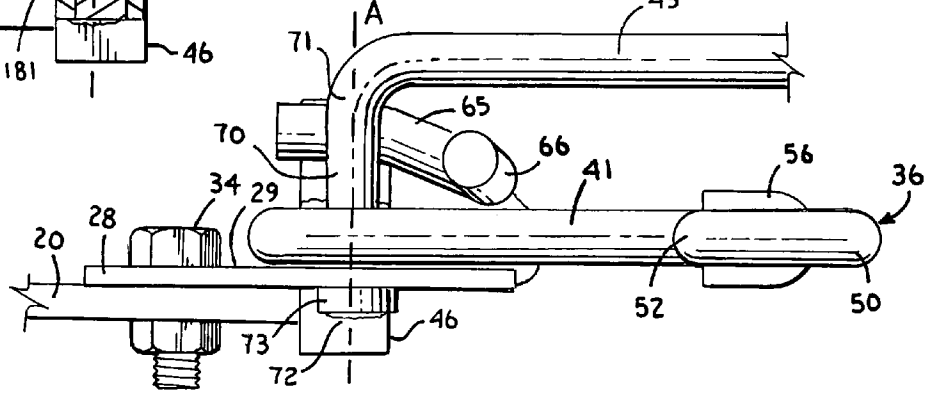
FIG. 3 is a greatly enlarged fragmentary top plan view of the form and the first spring loaded waler bracket clamp secured thereto.

With reference to FIGS. 3-5, the handle 55 is rotatable about a pivot axis A that runs parallel to the adjacent panels 14. The handle 55 pivots a clamp securing member or rotary cam or cam-lock 58 from the clamping configuration of FIG. 6 to the clamped configuration of FIG. 7 or vise versa. The cam-lock 58 is seen in cross section in FIGS. 4 and 5. The crank 43 has a stub 70 joined at a right angle relative to the handle 55 at a bend 71. The stub 70 has a distal end 72 that may be threaded and extends through a bore (not shown) in the connecting arm 28, so as to be pivotal therein and securely supported thereby. The stub 70 may be secured to the connecting arm 28 by a nut 73. It is foreseen that the stub 70 could alternatively be pivotally secured to connecting arm 28 by a ring welded thereto on an opposite side of the connecting arm 28 from the crank 43. The stub 70 rotates about an axis A.

Referring now to FIGS. 5 and 7, the illustrated cam-lock 58 includes an eccentric sleeve 80 that surrounds the stub 70 so as to have an outer cam surface 81 in engagement with the second section 42 and cam follower portion 44. As the cam surface 81 is rotated clockwise by turning the handle 55 from the non-clamping configuration of FIG. 6 to the clamping configuration of FIG. 7, the cam surface 81 protrudes further to the right (in FIG. 6) to urge the follower portion 44 to rotate about the pivot 46 and also to move the top thereof (in the vicinity of the second section 42) further to the right, thus rotating the entire spring 36 in a clockwise motion. In particular, when the handle 55 is moved away from the wall form 16 and upward about axis A, the cam-lock 58 urges the upper leg portion 41, the second surface 42, and the pivot or cam follower portion 44 of the spring 36, such that the upper leg portion 41 is shifted upwards and towards the wall form 16, and the second surface 42 pivots about axis A, which in turn causes the third surface 45 to pivot about a second pivot axis B, thus shifting the first arm 49, and, in turn, the free end 53 back towards the wall form 16 to create the clamped configuration, as seen in FIG. 7. The first end portion 39 is shifted upwards to compress and engage the second arm 52, such that the alignment arms 56 of the first end portion 39 are pushed towards the wall form, so as to capture the second arm 52 in the U-shaped gap of the alignment arms 56.

With reference to FIG. 7, in the clamping configuration, the first arm 49, the first end portion 39, and the second arm 52 are substantially parallel to the wall panels 14. When in the clamping configuration, the upper portions of the spring 36, especially the second arm 52, are resiliently biased against the crosspieces 24 and 24', so as to load the spring 36 and apply continuous pressure or force against the crosspieces 24 and 24', such that the crosspieces 24 and 24' are in turn biased against the studs 20, so as to be snugly held in place against the studs 20 by the force and the friction exerted on the crosspieces 24 and 24' by the spring 36 and adjacent regions of the studs 20. In particular, the second arm 52 applies force on a side surface 60 and 60' of the crosspieces 24 and 24', so as to clamp and lock the crosspieces 24 and 24' between the second arm 52 and the studs 20. When the spring 36 is under load, as seen in FIG. 7, the spring 36 is biased against the crosspieces 24 and 24', the second arm 52 moves somewhat rearwardly at the bottom thereof relative to the top while rotating at the fifth section 50 and this is the most noticeable location where the loading occurs; however, the first arm 49 will rotate some to the left at the top thereof while pivoting at the fourth section 48 and the leg portion 47 will rotate somewhat downward on the left while rotating about the third section 45. It is noted that the second arm 52 moves closer to the first end portion 38 when the spring 36 is loaded. It is also desirable for the crank 43 to provide significant leverage or mechanical advantage due both to the lever arm provided by the handle 55 and the operation of the cam surface 81 to deform and thereby load the spring 36 as it is rotated clockwise from the non-clamped configuration in FIG. 6 to the clamped configuration in FIG. 7 as it applies clamping pressure and force to the crosspieces 24 and 24'. The leverage provided by the handle 55 and the mechanical advantage provided by the cam surface 81 allow greater force to be applied to the spring than could typically be accomplished by the application of manual force without such leverage. It should be noted that friction between the outer surface 81 of the cam 58 and the surface 42 retains the crank 43 in the clamping position.

With reference to FIG. 6, in the non-clamping configuration, the second arm 52 is positioned a relatively short distance from sides 60 and 60' of crosspieces 24 and 24' or just touching at least one side 60, especially near a bottom 61 thereof. With clockwise rotation of the handle 55 about pivot axis A, the second arm 52 moves to engage and tightly mate with the crosspieces 24 and 24'. The cam-lock 58 and spring 36 of the clamp 12 allow for the various tolerances in specific sizes of crosspieces 24 and 24', i.e. 2"×4".

Figure 8:
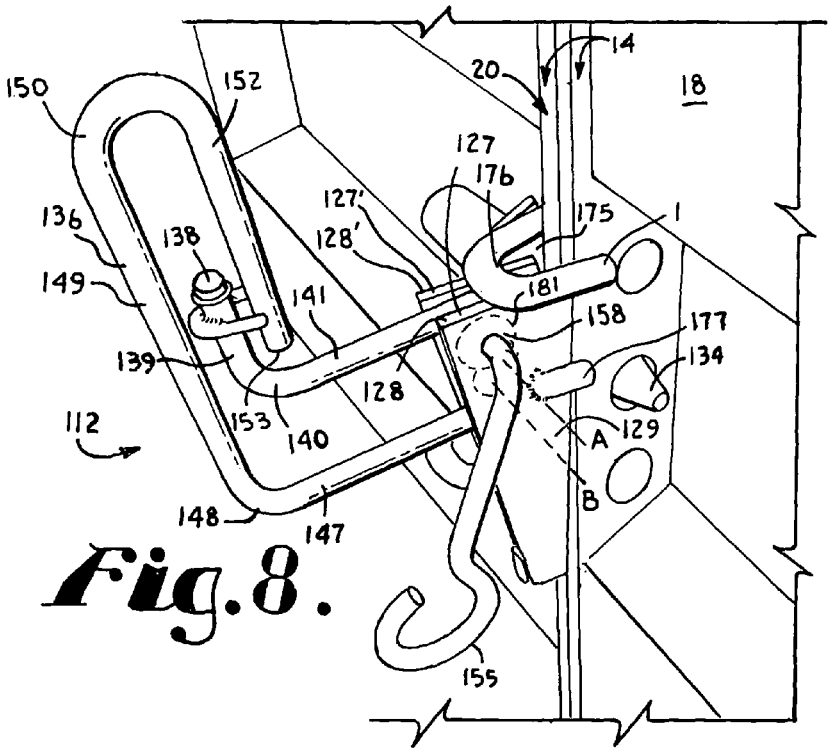
FIG. 8 is a fragmentary perspective view of the form and the second spring loaded waler bracket clamp according to the present invention, showing various details in phantom.
Figure 9:
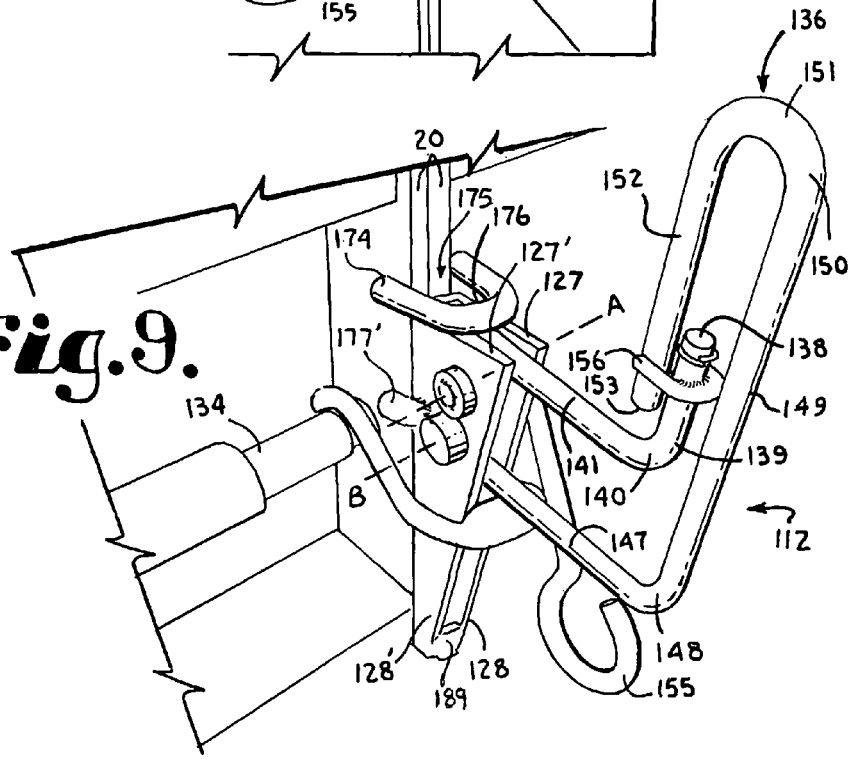
FIG. 9 is a fragmentary perspective view of the form and the second spring loaded waler bracket clamp according to the present invention, as seen in FIG. 8, showing various details in phantom.

With reference to FIGS. 8-9, a second embodiment of a clamp 112 is shown, and the clamp 112 has similar features as the clamp 12. The illustrated clamp 112 has a pair of spaced apart connecting arms or plates 128 and 128'. The connecting arms 128 and 128' provide structure for the clamp 112 to engage the studs 20 and for insertion between or against at least one stud 20 on the wall form panels 14. The illustrated connecting arms 128 and 128' are wedge shaped. The connecting arms 128 and 128' may be secured to one another in substantially parallel relation. The connecting arms 128 and 128' may be made from steel, aluminum or another metal or molded as an integral unit from glass filled nylon or another material.

The various sizes of the crosspieces 24 and 24' can be accommodated with an appropriately sized and configured clamp 112 according to this invention, in many cases a larger crosspiece (not shown) could be accommodated by enlarging top surfaces 127 of a connecting arm 128.

The clamp 112 includes a clamp member or spring 136 and handle 155 with a cam-lock (not shown), that is substantially identical to the spring 36 and handle 55 with cam-lock 58 in form and function, and is constructed for engagement with a crosspiece 24 or 24', as previous described herein.

The clamp 112 further includes a top surfaces 127 and 127' of the connecting arms 128 and 128' respectively, upon which are operably attached a rim 174, the rim 174 being U-shaped and positioned on both sides of the studs 20 in an abutting relationship with the studs 20 within an interior gap 175 and engaging an inner surface 176 of the U-shaped rim 174. The rim 174 operably supports at least one crosspiece 24 above the spring 136 to prevent interference with the movement thereof when loading the spring 136 by clockwise rotation thereof from the position in FIG. 8. Also, the connecting arms 128 and 128' have at least one alignment leg 177 or 177', on a respective side 129 and 129' of the connecting arms 128 and 128', and engaging one of at least two adjacent studs 20. As a result, when the clamp 112 is secured to the studs 20, the clamp 112 is prevented from sliding or rotating about a pin 134 relative to the studs 20 due to the interaction of the inner surface 176 of the rim 174 and the studs 20. The interaction between the wedge shaped structure of the connecting arms 128 and 128' and the studs 20 maintains the top surfaces 127 and 127' of the connecting arms 128 and 128' perpendicular to the studs 20, such that a generally rectangular shaped cross-section of the crosspiece 24 can rest on the upper surfaces 127 and 127' of the connecting arms 128 and 128' respectively and the rim 174.

The clamp 112, like the clamp 12, has a first end 138 having a first end portion 139 that is adjacent a first radiused curve section 140. The section 140 is adjacent an upper leg portion 141 that is then adjacent a second radiused curve section 142. The section 142 is spaced from a pivot crank with a handle 155. The spring 136 next includes a can follower portion (not seen) which in turn is adjacent a third radiused curve section (not seen) which is adjacent a lower leg portion 147 that is joined to a fourth radiused curve section 148. The section 148 joins with an upward extending first arm 149 that then joins with a fifth radiused curve section 150 that has an uppermost point 151. The section 150 joins with a second arm 152 and terminates at free end 153. Alignment arms 156 extend between portion 139 and second arm 152. Unlike the clamp 12, wherein the connection arm 28 has an aperture 30 to mate with a connecting pin 34 and aperture 22, the clamp 112 is positioned via the third lower leg 147. The third lower leg 147 is positioned below the spring 136 and operably attached to the connecting arms 128 and 128', as by welding a cross member 189 to rear edges of the arms 128 and 128'. The third lower leg 147 includes an elongated portion (not shown), adjacent a circular pathway or hook (not shown) creating an aperture (not shown), the aperture having an interior surface (not shown), sized and shaped such that a connecting pin 134, like pin 34 may pass through circular pathway aperture. The connecting pin 134 may further include a groove (not shown), in which the third lower leg engages so as to not allow for sliding about the connecting pin 134, and to further lock the clamp 112 about the studs 20. The third leg 147 is made from a integrally formed from steel, aluminum, or another metal or molded as an integral unit from glass filled nylon, or another material.

With reference back to FIG. 1, installation of the spring loaded waler bracket assembly 10 according to this invention is easily accomplished by securing a number of clamps 12 or clamps 112 or some combination thereof to the wall forms 16. The clamps 12 and 112 are connected to the wall forms 16 at the junctions 11 between the adjacent panels 14 by inserting pins 34 and 134 through the aligned apertures 22 in the studs 20 and through the aperture 30 in the connecting arm 28 of claim 12 or through similar apertures of clamp 112, as needed. After the appropriate number of horizontally aligned clamps 12 and 112 are secured by pins 34 and 134 to the wall forms 16, the crosspieces or walers 24 and 24' are placed on the upper surface 27 of the connecting arm 28 and the top surface 127 of connecting arms 128 and 128' and the rim 174 with each handle 55 and 155 in the unlocked position thereof. In the unlocked position, the second arms 52 and 152 are ideally minimally spaced from the crosspieces 24 and 24' to provide for easy and efficient installation of the crosspieces 24 and 24' on the clamps 12 and 112.

The clamps 12 and 112 are then placed in the locking position by rotating each of the handles 55 and 155 upwardly as shown by arrow C of FIG. 6, such that each of the respective terminal end portions 39, 52, 139, and 152 are compressed, and each second arm 52 and 152 engages the outer side surface 60 and 60' of the crosspieces 24 and 24' to thereby clamp the crosspieces 24 and 24' against the studs 20 of the wall form 16 and provide for reinforcement and alignment of the respective panels 14. Once each of the clamps 12 and 112 is translated into the clamping or locked position, the wall form is secured, and then concrete may be poured between the wall forms 16 and allowed to cure thereby forming the concrete wall.

With reference to FIG. **2*b* a clamp 212 has similar features to clamp 12, except for an elongated connecting arm 228 and top surface 227. The clamp 212 includes the connecting arm or member 228, to provide structure to secure the clamp 212 to the studs 20 and for insertion between or against at least one stud 20 on the wall form panels 14. The various sizes of the crosspieces 24 and 24' can be accommodated with appropriately sized and configured clamps 212 according to this invention, in many cases a larger crosspiece (not shown) is accommodated by the lengthened top surface 227 of the connecting arm or plate 228**.

The clamp 212 can be secured to the studs of FIG. 1 of adjacent panels 14 by inserting a pin 234 therethrough.

The clamp 212 includes a clamp member, referred to herein as a spring 236, pivotally mounted on the connecting arm 228. Preferably, the spring 236 is constructed from a single, unitary, integral, or monolithic elongated rod of constant cross section that is formed or bent at various locations therealong to form a clamp member having a substantially planar shape resembling an outline of the letter "L". As used herein, the term "monolithic" describes a single element, such as a rod, which is formed to a desired shape. The spring 236 has a first end 238, the first end 238 having a first end portion 239 being slightly non-parallel to the wall form 16 (see FIG. 1) when the clamp 212 is in a non-clamping configuration thereof. The first end portion 239 is adjacent a first radiused curve or corner section 240, that is in turn adjacent to an upper leg portion 241. The upper leg portion 241 runs substantially perpendicular to the wall form 16 in the non-clamping configuration. Continuing along the spring 236, adjacent to the upper leg portion 241 is a second radiused curve or corner section 242. The second curved section 242 is spaced from a first pivot crank 243. The first pivot crank 243 has a handle or lever 255. Adjacent the second curved section 242 is a cam engaging or cam follower portion 244, which in turn is adjacent a third radiused curve or corner section 245. The third curved section 245 is radiused about and secured, as by welding, to a pivot 246, which extending through an aperture (not shown) in the connecting arm 228.

Continuing further along the spring 236, and adjacent the third radiused section 245 is a lower leg portion 247. The lower leg portion 247 is generally perpendicular to the wall panel 14 in the non-clamping configuration and substantially parallel to the upper leg portion 241. Opposite the third radiused section on the lower leg portion is a fourth radiused curve or corner section 248, which in turn is adjacent a first arm 249 that extends upwardly from the fourth curved section 248 to run slightly off parallel with respect to the studs 20 when in use in the non-clamping configuration. The first arm 249 upwardly ends in a fifth radiused curve or corner section 250, that extends approximately 180 degrees. Extending downwardly from the fifth curved section 250 is a second or clamp arm 252 that extends to a terminus or free end 253. The first arm 249 and second arm 252 of the spring 236 form a saddle with the fifth curved section 250 in a U-shape about the first end 238 and the first end portion 239 of the spring 236.

In use the second arm 252 is a clamp component which engages the crosspieces 24 and 24' of FIG. 1.

The spring 236 and connecting arm 228 may be made from a resilient or spring-like material, such as steel (especially heat treated carbon steel), aluminum or another metal, or molded as an integral unit from a polymer or the like. The spring 236 shown is a simple torsion or flex spring.

The clamp 212 also includes a brace arm 262, operably attached to the connecting arm 228, and extending perpendicularly from either side of the connecting arm 228. The brace arm 262 includes an L-shaped brace 264, having a lower portion 265, and upper portion 266, and a curved portion 267. Adjacent to the lower portion 265 is the curved portion 267, and in turn adjacent to the curved portion 267 is the upper portion 266. The upper portion 266 functions as a brace to prevent the spring 236 from moving outward away from the connecting arm 228 under load. Like the spring 236, the brace 264 and brace arm 262 may be constructed of steel, aluminum or another metal, or rigid polymer such as nylon or another material.

Disassembly of the spring loaded waler bracket assembly 10 according to the present invention is easily accomplished by translating each handle 55 and 155 to the non-clamping configuration (counterclockwise rotation along line D in FIG. 7), removing the crosspieces 24 and 24', and releasing the pins 34 from each aperture 30 in the connecting arm 28 of clamp 12, and if applicable, and by releasing the pin 134. Once the pins 34 and 134 are removed, the clamps 12 and 112 themselves can be removed.

Figure 10:
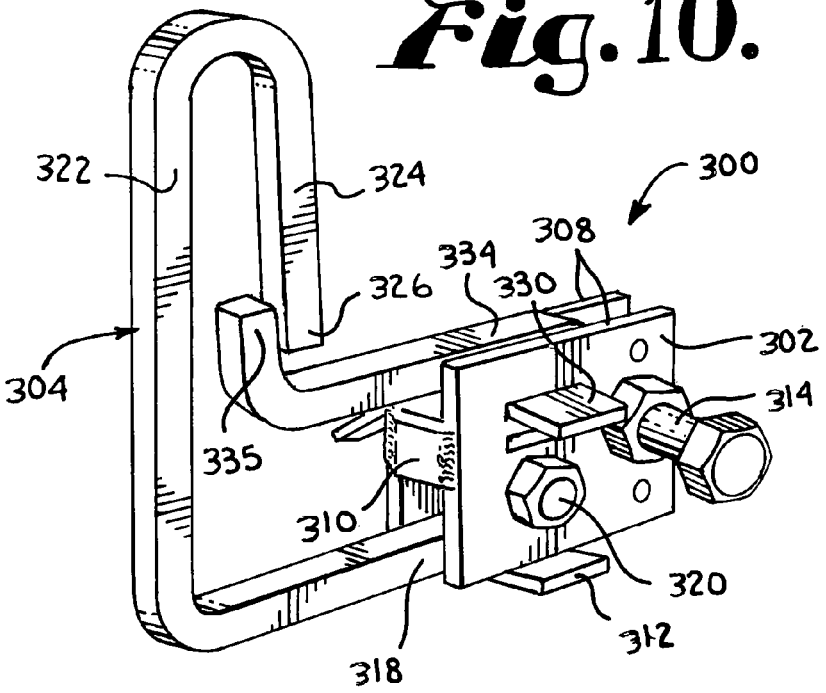
FIG. 10 is an enlarged perspective view of an alternative embodiment the spring loaded waler bracket clamp of the present invention in which a clamp member is urged into a clamping configuration by a wedge.

Referring to FIG. 10, a wedged waler clamp embodiment 300 of the spring loaded waler bracket clamp assembly, according to the present invention, is illustrated. The clamp assembly 300 includes a mounting bracket 302 having a clamp member 304 pivotally connected thereto. The illustrated mounting bracket 302 includes a pair of laterally spaced mounting plates 308 interconnected by cross members 310 and 312. The clamp assembly 300 is removably secured to a stud of the type studs 20 found in FIG. 1 by a fastener 314, such as a bolt.

The clamp member 304 is generally similar to the clamp member or spring 36 of the clamp assembly 10. The illustrated clamp member 304 is formed of an elongated monolithic or one-piece rod of a resilient or spring-like metal which is formed into a substantially planar shape resembling the outline of the letter "L". The illustrated clamp member 304 has a rectangular or square cross section, but it is foreseen that other cross-sectional shapes could be employed. The clamp member 304 has a lower mounting leg 318 which is pivotally mounted between the plates 308 of the mounting bracket 302 in a manner similar to the way the clamp member 36 is mounted on the connecting arm 28 of the embodiment shown in FIG. 1. For example, a disc (not shown) with an aperture welded to the mounting leg 318 receives a pivot fastener 320, such as a mounting bolt, which also passes through the mounting plates 308. The pivoting range of the clamp member 304 is limited, by contact of components of the clamp member 304 with the cross members 310 and 312.

The illustrated clamp member 304 includes an upper clamping leg 322 having a clamp component or clamp arm 324 with a free end 326 extending approximately parallel to the clamping leg 322. The clamp arm 324 is resiliently movable toward and away from the clamping leg 322 whereby the clamp arm 324 is able to apply a resiliently biased clamp force against a waler of the type shown in FIG. 1 engaged by the clamp assembly 304.

The clamp member 304 is pivotable between a non-clamping position in which the mounting leg 318 engages the cross member 312 and a clamping position in which the mounting leg 318 is angled away from the cross member 312. The clamp member 304 is urged to the clamping position by a wedge or wedge member 330 which is received through one of a set of aligned apertures or slots 332 formed in the mounting plates 308. The illustrated wedge 330 is curved and has an elongated triangular shape. The wedge 330 engages a wedge follower leg 334 of the clamp member 304 to urge the clamp member to the clamping position.

In use, the waler clamp assembly 300 is secured to the vertical stud 20 of a form panel 18 of the types shown in FIG. 1. A waler 24 and/or 24' is positioned in contact with upper edges of the mounting plates 308 with the clamp member 304 in the non-clamping position. The clamp member 304 may be pivoted toward the clamping position somewhat to enable a wedge member 330 to be inserted into an aligned set of wedge slots 332. The wedge member 330 is then hammered into the slots 332 to raise the clamp member 304 into the clamping position such that the clamp arm 324 is resiliently biased against the of the type of waler 24/24' of FIG. 1 to releasably secure it against the form panel 18 shown in FIG. 1. To release, the wedge member 332 is hammered in the opposite direction to enable the clamp member 304 to fall back to the non-clamping position. The clamp assembly 300 includes structure to limit flexure of the clamp arm 324, such as a limit stub 335 which extends upwardly from the wedge follower leg 334 of the clamp member 304. Although not shown, the wedged clamp assembly 300 may incorporate an alignment or guide structure similar to the alignment arms 56 of the clamp assembly 10 of the first embodiment.

Figure 11:
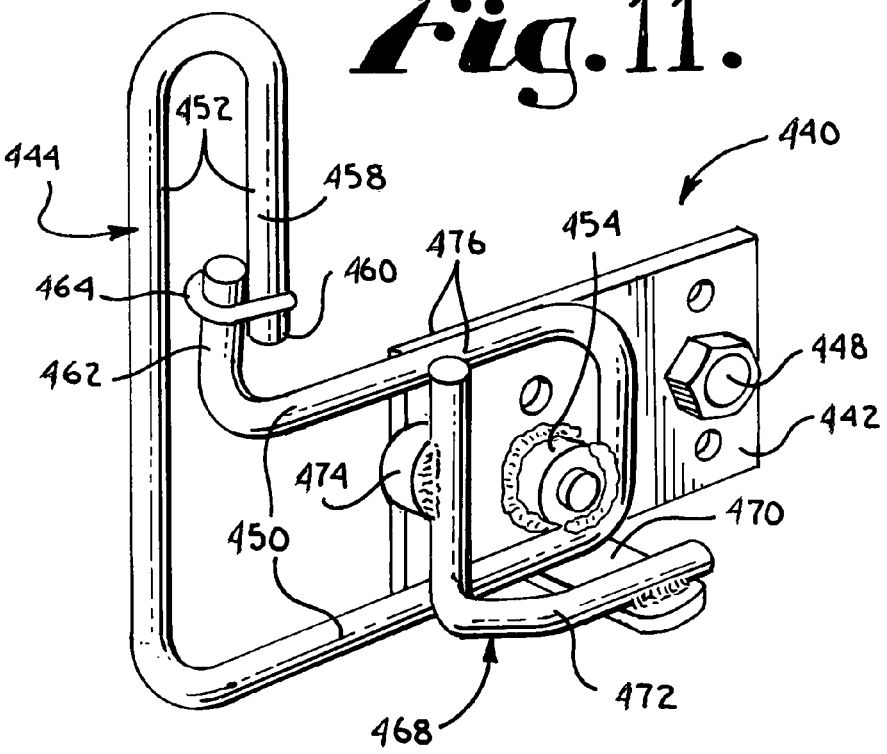
FIG. 11 is an enlarged perspective view of an alternative embodiment of the spring loaded waler bracket clamp of the present invention in which a clamp member with a resilient clamp arm is fixed in a clamping configuration.

FIG. 11 illustrates a fixed waler clamp embodiment 440 of the spring loaded waler bracket clamp assembly, according to the present invention. The illustrated fixed clamp assembly 404 includes a mounting arm or bracket 442 having a resilient clamp member or spring 444 mounted thereon. The exemplary mounting bracket 442 is a rectangular plate which is adapted for removable attachment to a stud 20 of a form panel 18 of the type shown in the first embodiment in FIG. 1, as by the use of a fastener 448, such as a threaded bolt and nut. The mounting bracket 442 has a length to accommodate a waler of a desired width.

The clamp member 444 is similar in construction and form to the clamp member or spring 36 of the first embodiment and is formed of a resilient or spring-like material, such as a spring steel alloy. The illustrated clamp member 444 is formed from an elongated rod which is bent or formed to a substantially planar shape resembling an outline of the letter "L". The clamp member 444 shown is formed from a rod having a circular cross section; however, it is foreseen that other cross sectional shapes would be appropriate. The clamp member 444 includes a lower, horizontally extending mounting leg 450 and an upper, vertically extending clamping leg 452. The mounting leg 450 is fixedly secured to the mounting bracket 442, as by welding. IL should be noted that the clamping member 444, as a whole, is not movable with respect to the mounting bracket 442. The illustrated mounting leg 450 is welded to a cylindrical member 454 which is then welded to the mounting bracket 442.

The clamping leg 452 includes a clamping arm 458 which is positioned for resiliently biased engagement with a waler 24/24' of the type shown in FIG. 1. The clamping arm 458 has a lower free-end 460 which enables the clamping arm to resiliently flex within the plane of the clamping member 444. The clamp member 444 includes a limit stub 462. The limit stub 462 includes a U-shaped alignment structure 464, similar to the alignment arms 56 of the assembly 10, described above.

The clamp assembly 440 includes a brace structure 468 to reinforce the assembly. The illustrated brace structure 468 includes a cross member 470 secured to the mounting bracket 442, as by welding, and an L-shaped brace member 472 which is welded to the cross member 470. The brace member 472 is preferably formed of a resilient material, such as a spring steel, and is illustrated to be a rod member formed to the L-shape. An upper leg of the brace member 472 has a cylindrical abutment member 474 welded thereto and bears against the mounting bracket 442. The clamp assembly 440 is somewhat planar in construction, and the brace structure 468 provides the clamp assembly as a whole with resistance against twisting and other kinds of undesired deformations during use.

In use, the fixed clamp assembly 440 is secured to a stud 20 of a form panel 18 of the type of the first embodiment shown in FIG. 1, using a fastener 448 through the mounting bracket 442. The mounting bracket 442 and the mounting leg 450 of the clamp member 444 form a support surface 476 having a length, as mounted, which is slightly less than the width of the walers 24/24' of the type to be used. Thus, the walers 24/24' must be forced into engagement with the support surface 476 against the resilient resistance of the clamping arm 458. This may be accomplished using a mallet or a hammer to force the walers 24/24' into place. A separate piece of wood (not shown) may be used to avoid damage to the walers 24/24'. The walers 24/24' are held in place by the resilient biasing force of the clamping arm 458. The walers 24/24' may be removed from the clamp assembly 440 by being hammered out of engagement with the clamp arm 458. It should be noted that the clamp assemblies 440 are normally used in sets of at least two assemblies 440.

It is to be understood that while certain forms of the present invention have been illustrated and described herein, it is not to be limited to the specific forms or arrangement of parts described and shown.

What is claimed and desired to be secured by Letters Patent is as follows:

1. A waler clamp device for releasably securing a waler to a panel and comprising:

(a) a mounting member adapted for securing to a panel;

(b) a clamp member pivotally connected to the mounting member and movable between a clamping configuration and a non clamping configuration by rotation of the clamp member relative to the mounting member;

(c) the clamp member including a resilient clamp component positioned adjacent the waler and upon rotation to the clamping configuration from the non clamping configuration to operably resiliently urge a waler toward a panel to thereby releasably secure the waler to the panel; and wherein (d) the clamp member includes a lever that is located between the mounting member and the clamp member and that is selectively manipulated to move the clamp member between the clamping configuration and the non clamping configuration.

2. A device as set forth in claim 1 including:

(a) a rotary cam member that is pivotally mounted on the mounting member and has a cam surface that engages the clamp member whereby rotary movement of the cam member causes movement of the clamp member between the clamping configuration and the release configuration; and (b) a cam lever operable by a user and secured to the cam member to enable movement of the cam member to thereby urge the clamp member to the clamping configuration to clamp a waler to a panel and to the release configuration to release a waler therefrom by rotation of the lever.

3. A device as set forth in claim 1 wherein the clamp member includes:

(a) a resilient element formed into an L-shape clamp member including the clamp component having a free end to enable resiliently biased engagement of the clamp component with a waler.

4. A device as set forth in claim 1 wherein the clamp member includes:

(a) a resilient element formed into a shape similar to an outline of the letter "L" and including the clamp component with a free end to enable resiliently biased engagement of the clamp component with a waler.

5. A device as set forth in claim 1 in combination with:

(a) an elongated waler;

(b) a panel; and (c) the waler clamp device releasably securing the waler to the panel.

6. A waler clamp device for releasably securing a waler to a panel and comprising:

(a) a mounting member adapted for securing to a panel;

(b) a clamp member connected to the mounting member and movable between a waler clamping configuration and a waler release configuration;

(c) a cam member pivotally mounted on the mounting member and having a rotatable cam surface engaging the clamp member whereby movement of the cam member causes movement of the clamp member between the clamping configuration and the release configuration;

(d) a cam lever operable by a user and secured to the cam member to enable movement of the cam member to selectively thereby urge the clamp member to the clamping configuration to clamp a waler to a panel and to the release configuration to release a waler therefrom; and (e) the clamp member is formed of a resilient material whereby the clamp member resiliently engages a waler clamped thereby.

7. A device as set forth in claim 6 wherein the mounting member includes:

(a) an elongated mounting plate having a length to enable positioning the clamp member in a selected spaced relation to a panel.

8. A device as set forth in claim 6 wherein the mounting member includes:

(a) a pair of mounting plates secured in substantially parallel spaced relation and having the clamp member, the cam member, and the cam lever positioned therebetween.

9. A device as set forth in claim 6 wherein the clamp member includes:

(a) a first leg engaged by the cam member; and (b) a second leg angularly extending from the first leg and positioned to engage a waler to clamp the waler to a panel.

10. A device as set forth in claim 6 wherein the clamp member includes:

(a) a resilient element formed into an L-shape clamp member including a clamp arm and a cam follower and (b) the cam member engaging the cam follower in such a manner as to cause the clamp arm to be pivoted into resilient engagement with a waler when the cam lever is pivoted from the release configuration to the clamping configuration and to provide continuous spring urging against the waler.

11. A device as set forth in claim 6 wherein the clamp member includes:

(a) a resilient element formed into a shape similar to an outline of the letter "L" and including a clamp arm with a free end to enable resiliently biased engagement of the clamp arm with a waler.

12. A device as set forth in claim 9 in combination with:

(a) an elongated waler;

(b) a panel; and (c) the waler clamp device releasably securing the waler to the panel.

13. A device as set forth in claim 12 wherein the mounting member includes:

(a) an elongated mounting plate having a length to enable positioning the clamp member in a selected spaced relation to a panel.

14. A device as set forth in claim 12 wherein the mounting member includes:

(a) a pair of mounting plates secured in substantially parallel spaced relation and having the clamp member, the cam member, and the cam lever positioned therebetween.

15. A device as set forth in claim 12 wherein the clamp member includes:

(a) a resilient element formed into an L-shape clamp member including a clamp arm and a cam follower and (b) the cam member engaging the cam follower in such a manner as to cause the clamp arm to be pivoted into resilient engagement with a waler when the cam lever is pivoted from the release configuration to the clamping configuration.

16. A device as set forth in claim 12 wherein the clamp member includes:

(a) a resilient element formed into a shape similar to an outline of the letter "L" and including a clamp arm with a free end to enable resiliently biased engagement of the clamp arm with a waler.

17. A waler clamp device for releasably securing a waler to a panel and comprising:

(a) a mounting member adapted for securing to a panel;

(b) a resilient clamp member pivotally mounted directly on and rotatable with respect to the mounting member and being rotatable between a waler clamping configuration and a waler release configuration;

(c) a cam member pivotally mounted on and rotatable with respect to the mounting member and engaging the clamp member whereby pivoting of the cam member causes movement of the clamp member between the clamping configuration and the release configuration; and (d) a cam lever secured to the cam member to enable a user to operably pivot the cam member to thereby selectively urge the clamp member between the clamping configuration to resiliently clamp a waler to a panel and to the release configuration to release a waler therefrom.

18. A device as set forth in claim 17 wherein the mounting member includes:

(a) an elongated mounting plate having a length to enable positioning the clamp member in a selected spaced relation to a panel.

19. A device as set forth in claim 17 wherein the mounting member includes:

(a) a pair of mounting plates secured in substantially parallel spaced relation and having the clamp member, the cam member, and the cam lever positioned therebetween.

20. A device as set forth in claim 17 wherein the clamp member includes:

(a) a first leg engaged by the cam member; and (b) a second leg angularly extending from the first leg and positioned to engage a waler to clamp the waler to a panel.

21. A device as set forth in claim 17 wherein the clamp member includes:

(a) a resilient element formed into an L-shape clamp member including a clamp arm and a cam follower and (b) the cam member engaging the cam follower in such a manner as to cause the clamp arm to be pivoted into continuous resilient engagement with a waler when the cam lever is pivoted from the release configuration to the clamping configuration.

22. A device as set forth in claim 17 wherein the clamp member includes:

(a) a resilient element formed into a shape similar to an outline of the letter "L" and including a clamp arm with a free end to enable resiliently biased engagement of the clamp arm with a waler.

23. A waler clamp device for releasably securing a waler to a panel and comprising:

(a) a mounting member adapted for securing to a panel;

(b) a resilient clamp member pivotally mounted on and being rotatable with respect to the mounting member and movable between a waler clamping configuration and a waler release configuration, the clamp member including:

(1) a first leg engaged by a cam member; and (2) a second leg angularly extending from the first leg and being positioned to engage a waler to clamp the waler to a panel;

(c) the cam member being pivotally mounted on and being rotatable with respect to the mounting member and having projecting cam surface engaging the clamp member whereby pivoting of the cam member causes movement of the clamp member between the clamping configuration and the release configuration; and (d) a cam lever secured to the cam member to enable a user to selectively pivot the cam member to thereby urge the clamp member between the clamping configuration to resiliently clamp a waler to a panel and the release configuration to release a waler therefrom.

* * * * *